US009691537B2

(12) United States Patent
Malcolm et al.

(10) Patent No.: US 9,691,537 B2
(45) Date of Patent: Jun. 27, 2017

(54) POWER SUPPLY MODULE

(71) Applicant: Sumida Electric (H.K.) Company Limited, Hong Kong (CN)

(72) Inventors: Douglas James Malcolm, Algonquin, IL (US); Yanfei Liu, Ontario (CA); Guoping Zhang, Hong Kong (CN)

(73) Assignee: Sumida Electric (H.K.) Company Limited, Hong Kong (CN)

( * ) Notice: Subject to any disclaimer, the term of this patent is extended or adjusted under 35 U.S.C. 154(b) by 136 days.

(21) Appl. No.: 14/219,156

(22) Filed: Mar. 19, 2014

(65) Prior Publication Data

US 2014/0285297 A1 Sep. 25, 2014

(30) Foreign Application Priority Data

Mar. 22, 2013 (CN) ..... 2013 2 0135917 U

(51) Int. Cl.

| | |
|---|---|
| ***H01F 5/00*** | (2006.01) |
| ***H01F 27/28*** | (2006.01) |
| ***H01F 27/22*** | (2006.01) |
| ***H01F 27/30*** | (2006.01) |
| ***H01F 27/40*** | (2006.01) |

(52) U.S. Cl.
CPC ..... *H01F 27/22* (2013.01); *H01F 27/306* (2013.01); *H01F 27/40* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 2009/0207574 | A1* | 8/2009 | Chen et al. | 361/761 |
| 2011/0242775 | A1* | 10/2011 | Schaible et al. | 361/752 |
| 2012/0229986 | A1* | 9/2012 | Huda | 361/720 |

FOREIGN PATENT DOCUMENTS

| | | | |
|---|---|---|---|
| JP | 06181120 A | * | 6/1994 |
| JP | 11299225 A | * | 10/1999 |
| JP | 2003188023 A | * | 7/2003 |

* cited by examiner

*Primary Examiner* — Tsz Chan
(74) *Attorney, Agent, or Firm* — Seyfarth Shaw LLP

(57) ABSTRACT

A power supply module is disclosed. the power supply module includes a coil including a coil body and connecting terminals; an electronic component including at least an integrated circuit chip; a magnetic core configured to enclose in and around the coil body, wherein a recess is provided on at least one side surface of the magnetic core, the electronic components are located in the recess, and an opening is provided on at least one side wall of the recess; a connector configured to be tightly attached to and cover the side surface where the recess is provided, and be electrically connected with the coil and the electronic component; and a heat conducting material provided in the recess and configured to cover the electronic component.

7 Claims, 11 Drawing Sheets

POWER SUPPLY MODULE

FIELD OF THE INVENTION

The present disclosure relates generally to the field of power supply, and particularly to a power supply module.

BACKGROUND OF THE INVENTION

In the field of electronic products, in order to provide an accurate voltage and an accurate current for an operation of an electronic product, electronic components such as inductance, capacitance, resistance and integrated circuit chip, are integrated into one power supply module, using, for example, Power Supply in Package (PSiP) technology, to perform voltage or current conversion. One common practice to achieve the above objective is to assemble the above individual electronic components together by a certain circuit connection respectively, which generally takes a larger space, and results in an increase of material cost and labor cost of products.

However, when the miniaturization is achieved, the existing power supply module might be subject to a defect caused by heat cycling or thermal cycling, so the applicant makes improvements in the power supply module that the coil body is enclosed in and around a magnetic core, a recess is provided on at least one side surface of the magnetic core, a heat conducting material is added in the recess between the electronic component and the magnetic core so as to provide better heat transfer characteristics from electronic component to ambient.

Though the structure improves the heat transfer characteristics, it brings another potential problem that it is not easy to fill the heat conducting material because a relatively closed space (or air bubble) may be formed in the recess when filling the heat conducting material and the side wall of the recess may be damaged by the high temperature expansion of the heat conducting material after filling the heat conducting material so as to reduce the quality and yield of the power product.

SUMMARY OF THE INVENTION

Based on the above, in order to solve the above problems in the prior art, the objective of the present disclosure is to provide a power supply module, which can conveniently fill the heat conducting material so as to prevent the side wall of the from being damaged to avoid yield problem and quality problem of product.

According to an aspect of the present disclosure, a power supply module includes:

a coil, including a coil body and connecting terminals;

an electronic component, including at least an integrated circuit chip;

a magnetic core, configured to enclose in and around the coil body, wherein a recess is provided on at least one side surface of the magnetic core, the electronic components are located in the recess, and an opening is provided on at least one side wall of the recess;

a connector, configured to be tightly attached to and cover the side surface where the recess is provided, and be electrically connected with the coil and the electronic component; and a heat conducting material, provided in the recess, and configured to cover the electronic component and to secure the magnetic core to the electronic component and the connector.

Preferably, the magnetic core includes a main body side and a recess side, and the recess is located on the recess side.

Preferably, the coil is located in the main body side, the recess is located on the side of the coil, the coil and the recess are arranged in a left-right positional relationship.

Preferably, the side wall of the recess that is close to the main body side is an inner side wall, and the opening is located on the opposite side or adjacent side of the inner side wall.

Preferably, the width of the opening is equal to or smaller than the width of the side wall.

Preferably, there are two openings, and the openings are opposite to each other and located on the two adjacent sides of the inner side wall respectively.

Preferably, the opening is located on the opposite side of the inner side wall and at least one adjacent side of the inner side wall.

Preferably, the opening is located on the opposite side and two adjacent sides of the inner side wall.

Preferably, the coil is located in the main body side, the recess is located beneath the coil, and the coil and the recess are arranged in an up-down or top-bottom positional relationship.

Preferably, the edge of at least one side of the main body side extends to the recess side to form the side wall.

Preferably, the width of the opening is equal to or smaller than the width of the corresponding side of the main body Preferably, the opening is provided between two opposite side walls.

Preferably, there are two opening, which are opposite to each other and provided between two opposite side walls respectively.

Preferably, the heat conducting material is one kind of adhesive material.

Preferably, the heat conducting material is provided only between the integrated circuit chip and the magnetic core.

The advantages and principles of the above technical solution are described below.

1. Because the side wall of the recess of the magnetic core is provided with an opening, the recess can be filled with the heat conducting material through the opening during manufacturing process, and after filling the heat conducting material, the heat conducting material will overflow from the opening when heated to expand, so as to prevent the side wall of the recess from being damaged to improve the production yield and quality of the product; and 2. The openings can be placed on one side wall of the recess, and also can be placed on two or more side walls of the recess. Relative to the main body side of the magnetic core, the openings can be arranged in right-left or up-down positional relationship, in case of the right-left positional relationship the width of the opening can be equal to or smaller than the width of the side wall, and in case of the up-down positional relationship the width of the opening can be equal to or smaller than the width of the corresponding main body side; and 3. The heat conducting material can be partially filled through the opening to reduce the cost and production time; and 4. As the heat conducting material is adhesive, it also helps to bind the magnetic core to the electronic components and connector more reliably.

5. In some cases, it is preferred to provide very small quantity of heat conductive material between the integrated circuit chip and magnetic core only.

DESCRIPTION OF THE REFERENCE SIGNS

10—coil,
20—electronic component,
30—magnetic core,
31—recess,
32—opening,
33—inner side wall,
40—connector, and
50—heat conducting material.

DETAILED DESCRIPTION OF THE INVENTION

The present disclosure may be best understood by reference to the following description taken in conjunction with reference to the accompanying drawings.

Embodiment 1

Figure 1:
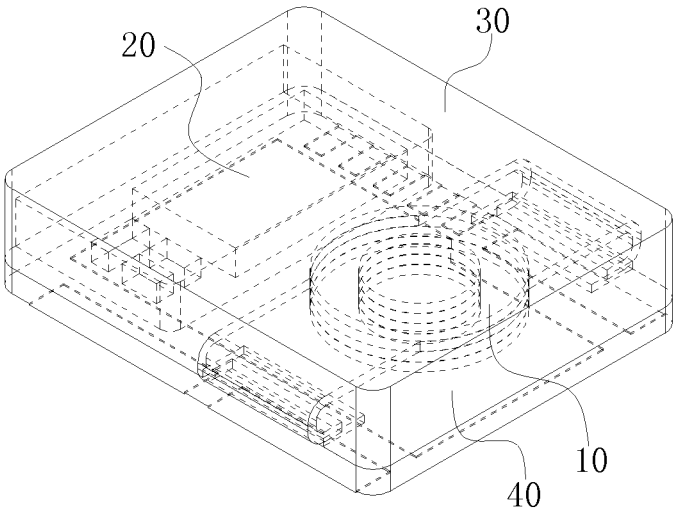
FIG. 1 is a space perspective view illustrating a power supply module according to embodiment 1 of the present disclosure.
Figure 2:
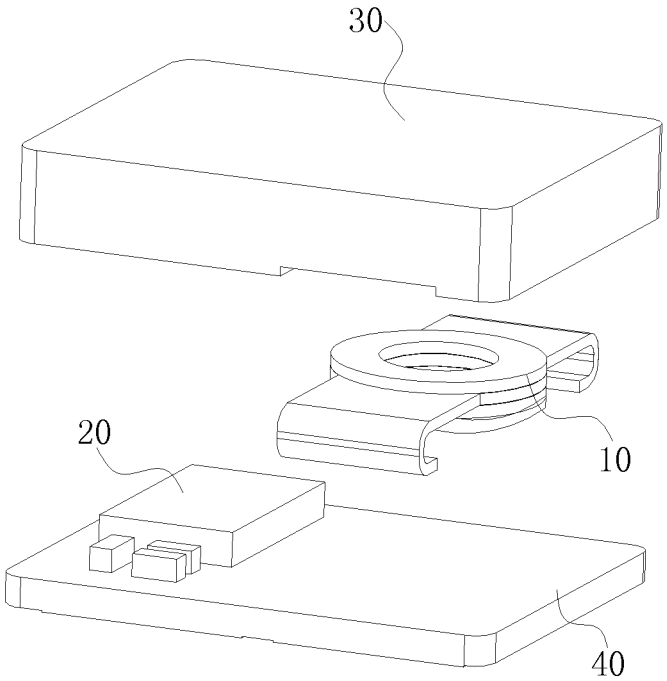
FIG. 2 is an explode view illustrating a power supply module along a first direction according to embodiment 1 of the present disclosure.
Figure 3:
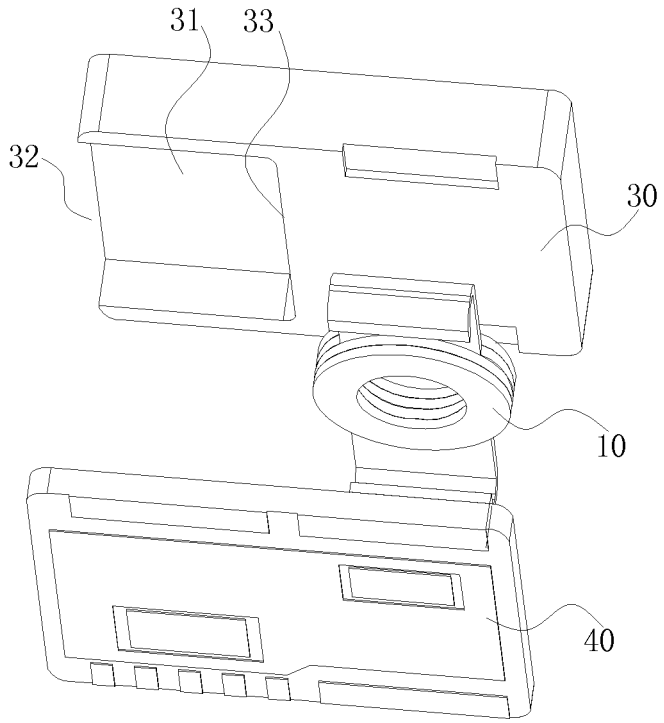
FIG. 3 is an explode view illustrating a power supply module along a second direction according to embodiment 1 of the present disclosure.
Figure 4:
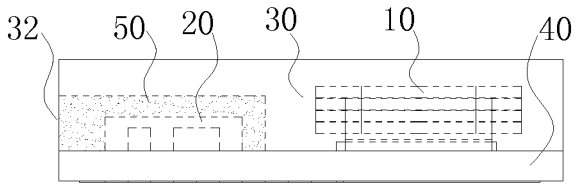
FIG. 4 is a lateral perspective view illustrating a power supply module according to embodiment 1 of the present disclosure.
Figure 5:
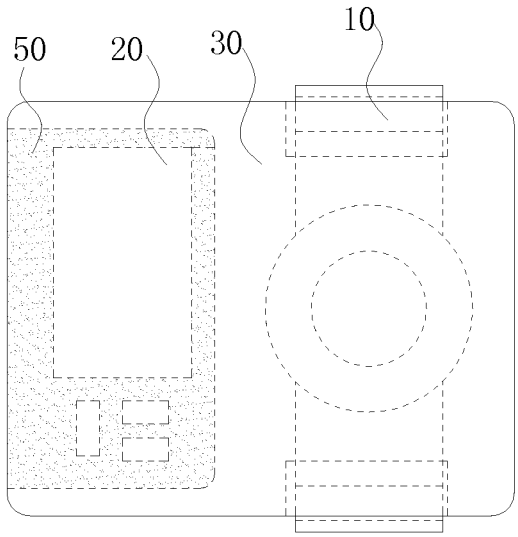
FIG. 5 is a top perspective view illustrating a power supply module according to embodiment 1 of the present disclosure.

As shown in FIGS. 1-5, a power supply module includes: a coil including a coil body and connecting terminals; an electronic component including at least an integrated circuit chip; a magnetic core configured to enclose in and around the coil body, wherein a recess is provided on at least one side surface of the magnetic core, the electronic components are located in the recess, and an opening is provided on at least one side wall of the recess; a connector configured to be tightly attached to and cover the side surface where the recess is, and be electrically connected with the coil and the electronic component; and a heat conducting material provided in the recess and configured to cover the electronic component and to secure the magnetic core to the electronic component and the connector.

The magnetic core includes a main body side and a recess side, and the recess is located on the recess side. The coil is located in the main body side, the recess is located on the side of the coil, wherein the coil and the recess are arranged in a left-right positional relationship. The side wall of the recess that is close to the main body side is an inner side wall, and in the embodiment, the opening is located on the opposite side of the inner side wall.

The embodiment has the advantage that: because the side wall of the recess of the magnetic core is provided with an opening, the recess can be filled with the heat conducting material through the opening during manufacturing process, and after filling the heat conducting material, the heat conducting material can overflow from the opening when heated to expand, so as to prevent the side wall of the recess from being damaged and to improve the production yield and quality of the product. Depending on the situation, the width of the opening can be adjusted in the range of equal to or smaller than the width of the side wall.

The heat conducting material can be an epoxy combines with a kind of material which has good heat conductivity.

The heat conducting material can be partially filled through the opening to reduce the cost and production time;

In some cases, it is preferred to add very small quantity of heat conductive material between the integrated circuit chip and the magnetic core only;

Embodiment 2

Figure 6:
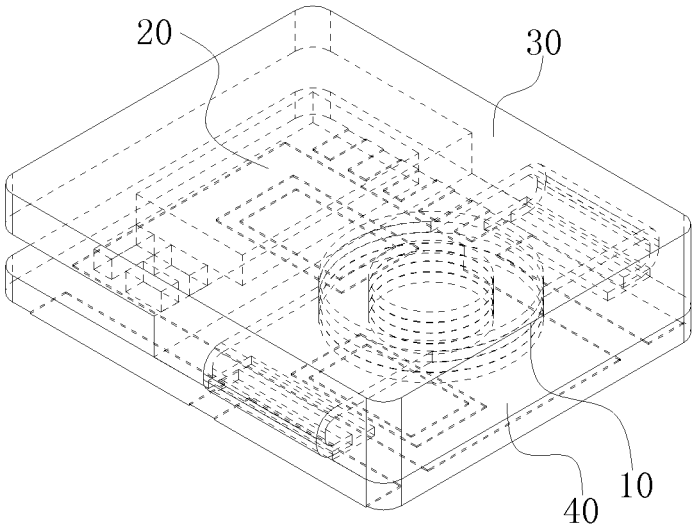
FIG. 6 is a space perspective view illustrating a power supply module according to embodiment 2 of the present disclosure.
Figure 7:
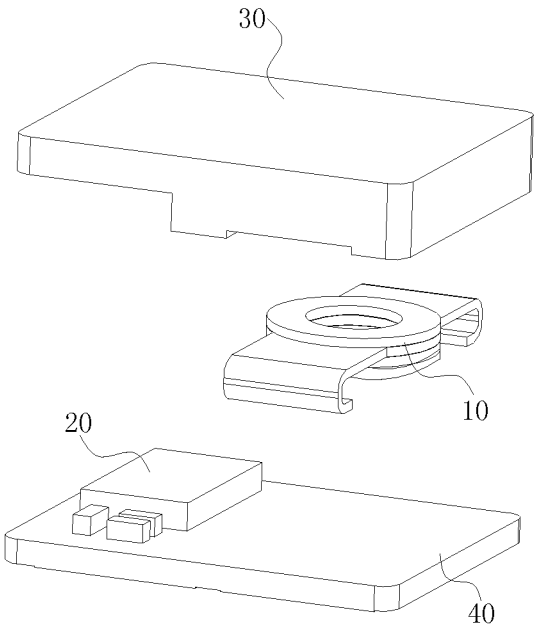
FIG. 7 is an explode view illustrating a power supply module along a first direction according to embodiment 2 of the present disclosure.
Figure 8:
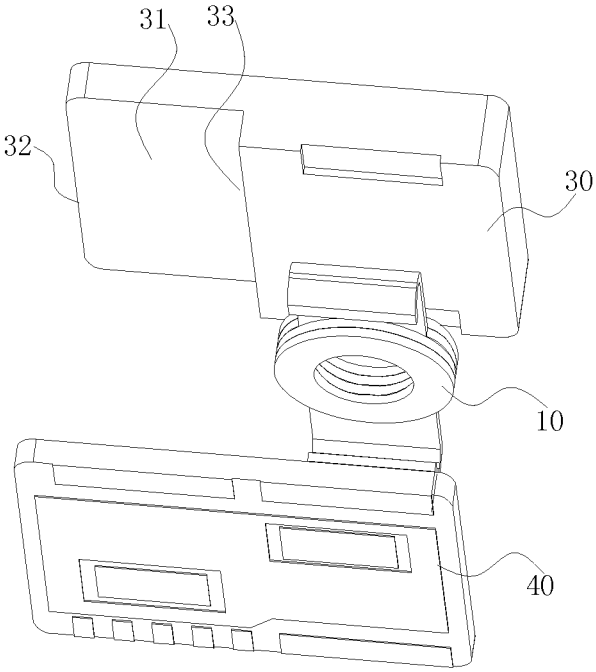
FIG. 8 is an explode view illustrating a power supply module along a second direction according to embodiment 2 of the present disclosure.
Figure 9:
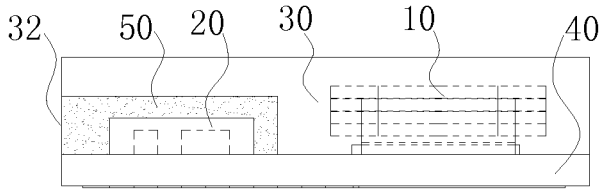
FIG. 9 is a lateral perspective view illustrating a power supply module according to embodiment 2 of the present disclosure.
Figure 10:
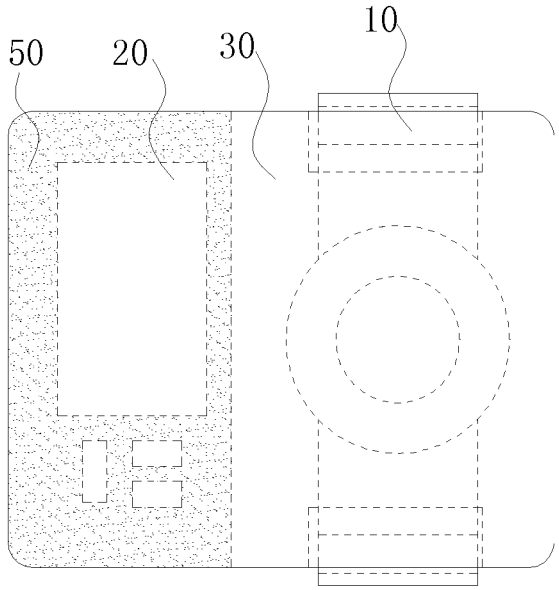
FIG. 10 is a top perspective view illustrating a power supply module according to embodiment 2 of the present disclosure.

As shown in FIGS. 6-10, the principle of the embodiment 2 is the same as that of the Embodiment 1, while the difference is that: in the embodiment 2, there are three openings which are located on the opposite side and two adjacent sides of the inner side wall respectively. The advantage of the embodiment 2 is the same as that of the Embodiment 1, so it's not described in detail here to avoid repetition.

Embodiment 3

Figure 11:
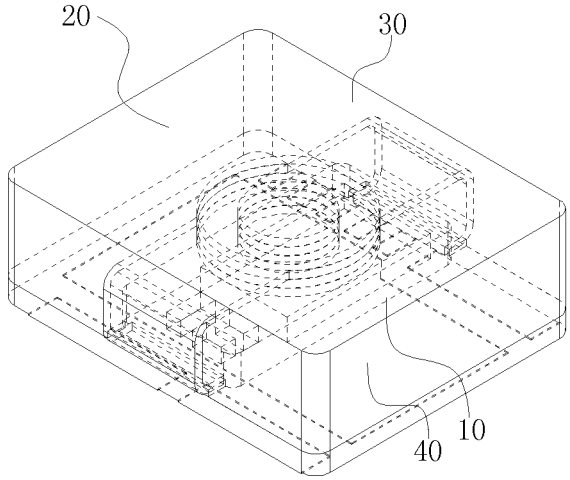
FIG. 11 is a space perspective view illustrating a power supply module according to embodiment 3 of the present disclosure.
Figure 12:
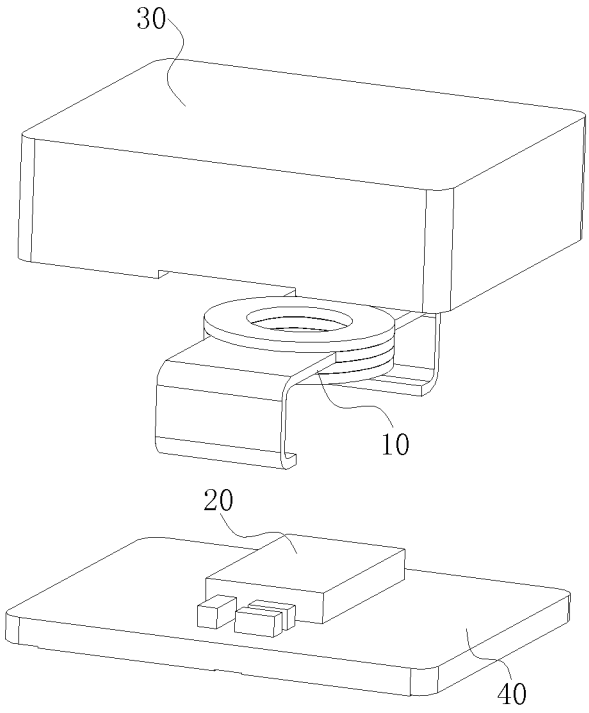
FIG. 12 is an explode view illustrating a power supply module along a first direction according to embodiment 3 of the present disclosure.
Figure 13:
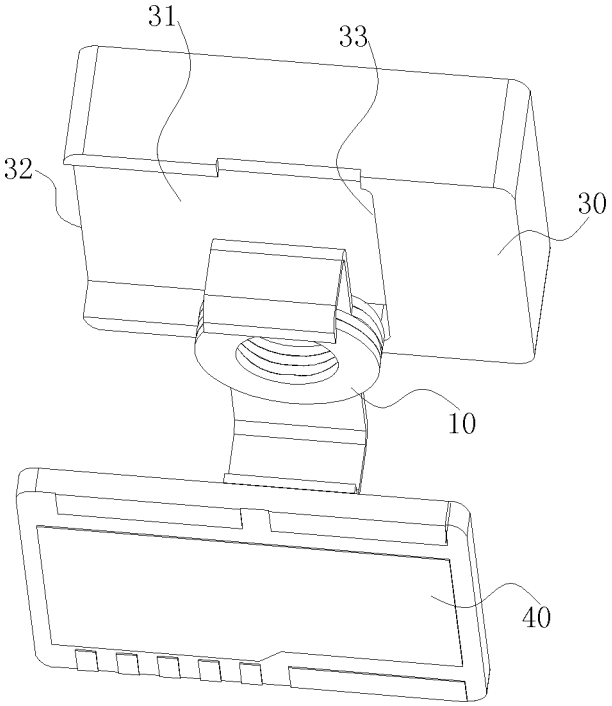
FIG. 13 is an explode view illustrating a power supply module along a second direction according to embodiment 3 of the present disclosure.
Figure 14:
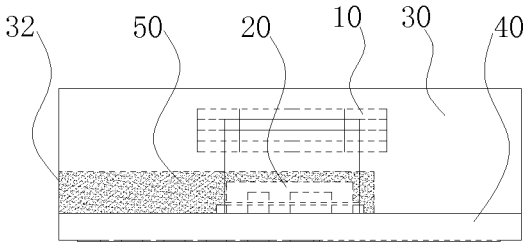
FIG. 14 is a lateral perspective view illustrating a power supply module according to embodiment 3 of the present disclosure.
Figure 15:
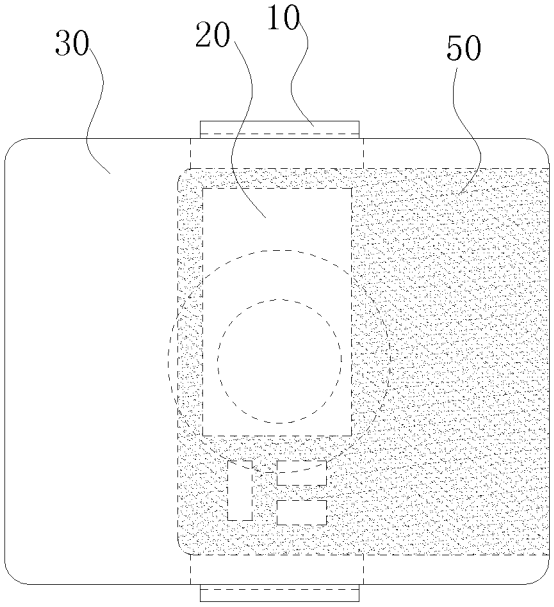
FIG. 15 is a top perspective view illustrating a power supply module according to embodiment 3 of the present disclosure.

As shown in FIGS. 11-15, the principle of the embodiment 3 is the same as that of the Embodiment 1, while the differences are that: in the embodiment 3, the coil is located in the main body side, the recess is located beneath the coil, and the coil and the recess are arranged in an up-down (or top-bottom) positional relationship; the edge of at least one side of the main body side extends to the recess side and forms the side wall; and the opening is provided between two opposite side walls; and the width of the opening can be adjusted in the range of equal to or smaller than the width of the corresponding main body side. The advantage of the embodiment is the same as that of the Embodiment 1, so it's not described in this to avoid repetition.

Embodiment 4

Figure 16:
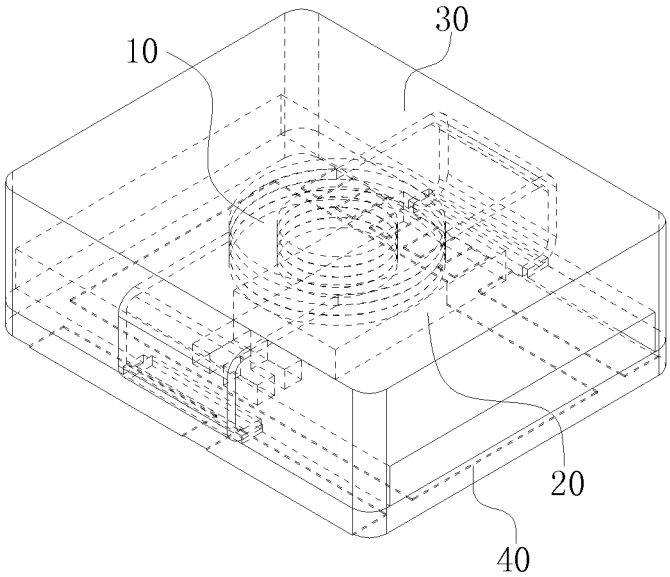
FIG. 16 is a space perspective view illustrating a power supply module according to embodiment 4 of the present disclosure.
Figure 17:
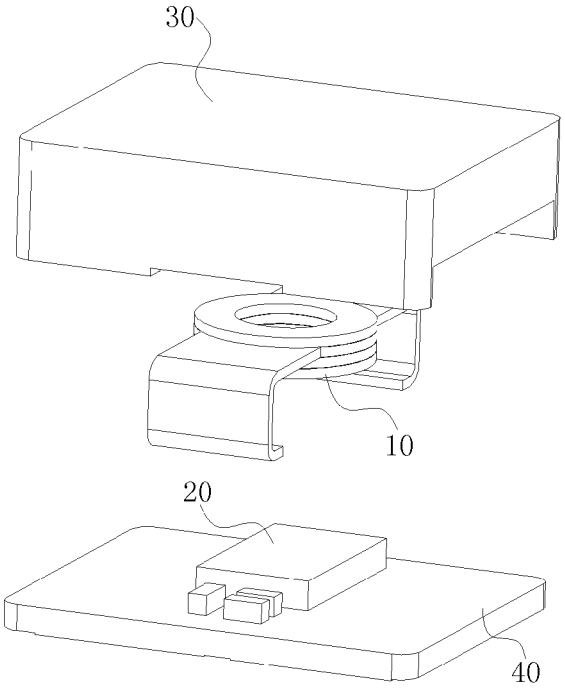
FIG. 17 is an explode view illustrating a power supply module along a first direction according to embodiment 4 of the present disclosure.
Figure 18:
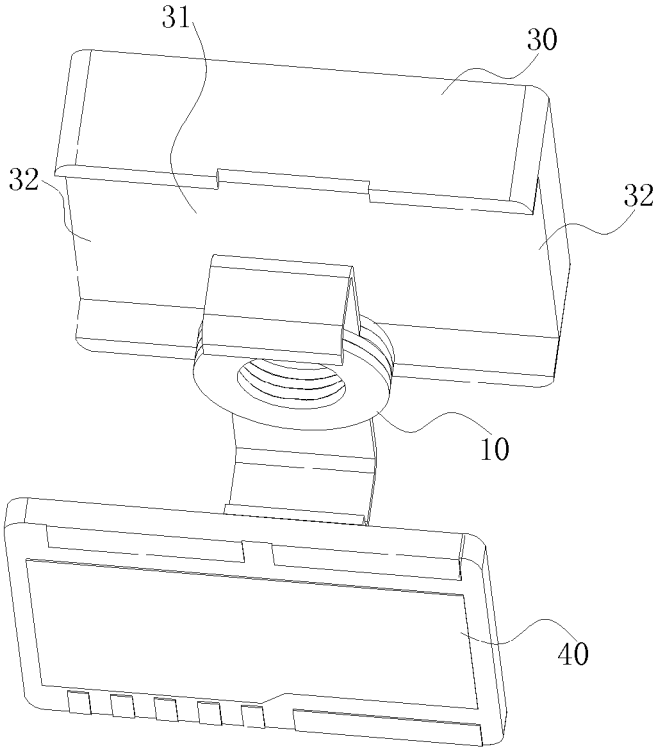
FIG. 18 is an explode view illustrating a power supply module along a second direction according to embodiment 4 of the present disclosure.
Figure 19:
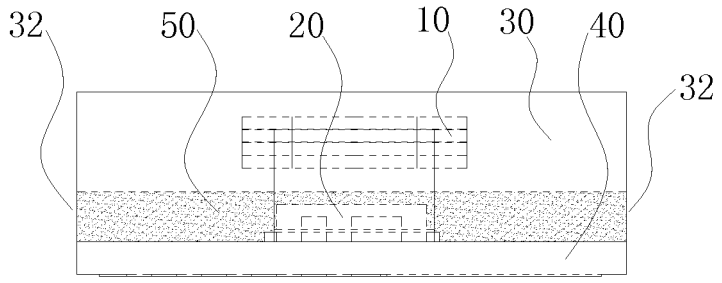
FIG. 19 is a lateral perspective view illustrating a power supply module according to embodiment 4 of the present disclosure.
Figure 20:
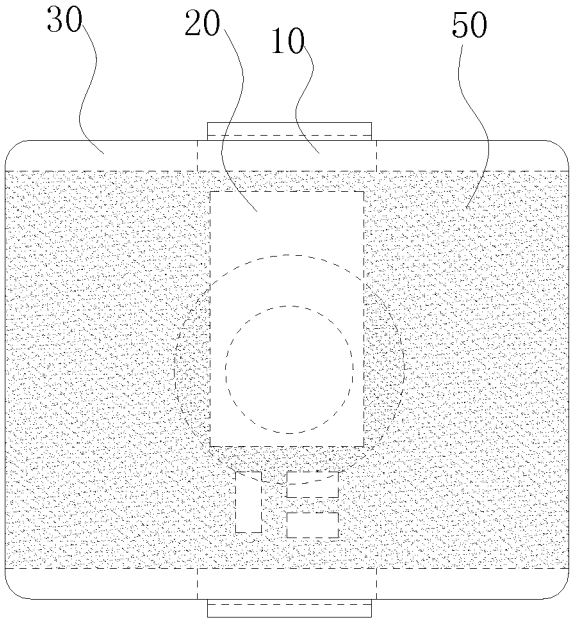
FIG. 20 is a top perspective view illustrating a power supply module according to embodiment 4 of the present disclosure.
Figure 21:
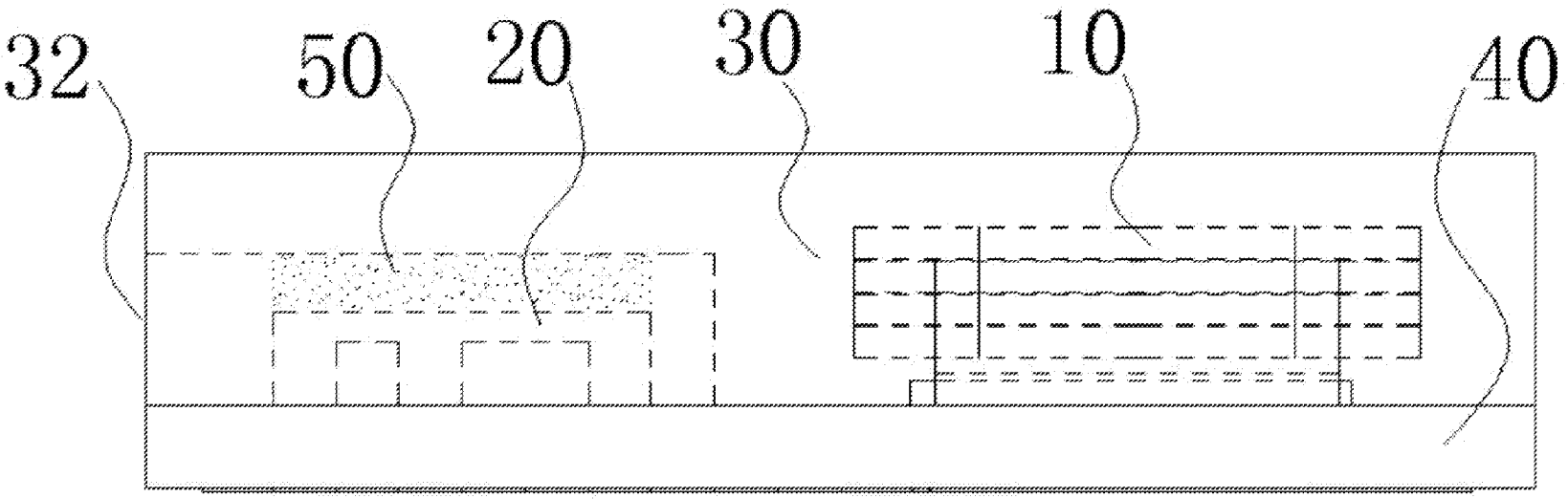
FIG. 21 is a lateral perspective view illustrating a power supply module according to embodiments of the present disclosure.

As shown in FIGS. 16-20, the principle of the embodiment 4 is the same as that of the Embodiment 3, while the difference is that: in the embodiment 4, the coil is located in the main body side, the recess is located beneath the coil, the coil and the recess are arranged in an up-down positional relationship, and there are two openings which are opposite to each other and located on the two adjacent sides of the inner side wall respectively. The advantage of the embodiment is the same as that of the Embodiment 1, so it's not described in detail here to avoid repetition.

The embodiments are chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its basic idea and scope. Accordingly, the scope of the present disclosure is defined by the appended claims rather than the foregoing description and the exemplary embodiments described therein.

What is claimed is:

1. A power supply module comprising:

a coil including a coil body and connecting terminals;

an electronic component including an integrated circuit chip;

a magnetic core enclosing the coil body, wherein a recess is defined on a side surface of the magnetic core, the electronic component is disposed in the recess, and an opening is defined on a side wall of the recess;

a connector is attached to and covers the side surface, and further electrically connected with the coil and electronic component; and a heat conducting material is disposed in the recess and covering the electronic component and coupling the magnetic core to the electronic component and the connector.

2. The power supply module of claim 1, wherein the magnetic core includes a main body side and a recess side, and wherein the recess is defined on the recess side.

3. The power supply module of claim 2, wherein the coil is disposed on the main body side, and the coil and the recess are disposed in a left-right positional relationship.

4. The power supply module of claim 3, wherein the side wall is an inner side wall disposed close to the main body side, and the opening is defined on an opposite side wall or an adjacent side wall of the inner side wall.

5. The power supply module of claim 4, wherein the heat conducting material is an adhesive material.

6. The power supply module of claim 4, wherein the heat conducting material is disposed only between the integrated circuit chip and the magnetic core.

7. The power supply module of claim 4, wherein a width of the opening is equal to or smaller than a width of the inner side wall.

* * * * *